US005470197A

United States Patent [19]

Cafarelli

[11] Patent Number: 5,470,197

[45] Date of Patent: Nov. 28, 1995

[54] TURBINE PUMP WITH BOUNDARY LAYER BLADE INSERTS

[76] Inventor: Robert S. Cafarelli, 467 Flag Branch Rd., Greeneville, Tenn. 37743

[21] Appl. No.: 331,017

[22] Filed: Oct. 28, 1994

[51] Int. Cl.[6] ..... F01D 1/36

[52] U.S. Cl. ..... 415/90; 415/26

[58] Field of Search ..... 415/90, 199.2, 415/26, 146

[56] References Cited

U.S. PATENT DOCUMENTS

| | | | |
|---|---|---|---|
| 1,061,206 | 5/1913 | Tesla . | |
| 4,417,877 | 11/1983 | Krautkremer et al. | 415/26 |
| 4,421,412 | 12/1983 | Hold et al. | 415/90 |
| 4,516,674 | 5/1985 | Firth | 415/90 |

FOREIGN PATENT DOCUMENTS

| | | | |
|---|---|---|---|
| 1122754 | 9/1956 | France | 415/90 |
| 3105179 | 9/1982 | Germany | 415/26 |
| 0148914 | 11/1979 | Japan | 415/26 |
| 2099795 | 4/1990 | Japan | 415/90 |
| 0315321 | 8/1963 | United Kingdom | 415/146 |

*Primary Examiner*—Edward K. Look
*Assistant Examiner*—Mark Sgantzos
*Attorney, Agent, or Firm*—McHale & Slavin

[57] ABSTRACT

The instant invention is a self-adjusting blade insert used for improving the efficiency of low rotating disc pumps by use of pivotal disc inserts disposed between the rotating discs of a multi-disc pump turbine style pump causing a positive displacement of fluid during the low rotating conditions or low viscosity fluid environment. The blade inserts of the instant invention include a biasing spring which allows the blade inserts to pivot outward when sufficient hydraulic pressure creates force against a lower surface of the blade inserts allowing maximum flow at higher rotations or predetermined operating conditions.

7 Claims, 2 Drawing Sheets

TURBINE PUMP WITH BOUNDARY LAYER BLADE INSERTS

FIELD OF THE INVENTION

The present invention relates to pumps and more particularly to an improved turbine style pump using self adjusting boundary layer blade inserts positioned between the discs of the pump.

BACKGROUND OF THE INVENTION

There exists in the art a variety of pump designs and configurations. All pumps have a primary purpose of transferring fluid, some of which perform the task in an energy efficient manner. Positive displacement pumps provide fluid transfer but require certain preexisting conditions for proper operation. Operation of a positive displacement pump on low influent fluid pressure will cause cavitation which results in irreparable damage to pump vanes. Positive displacement pumps are beneficial in that they operate on any speed motor and thus are not dependent upon the rotations per minute of the pump. For this reason, the positive displacement pump can transfer fluid at any rate as long as there is sufficient influent pressure so as to prevent cavitation and the motor revolutions thereafter determine the amount of volume the pump will transfer.

Another well known type of pump is referred to as a centrifugal pump wherein a rotating vane with patterned orifice allows fluid transfer in an efficient manner having less stringent influent fluid specifications to resist cavitation.

The problem with centrifugal pumps is that they rely upon centrifugal force whereby the influent fluid is directed outward through curved vanes placed upon substantially flat discs toward the outer diameter of the disc providing the pump pressurization. While this pump is resistant to cavitation at low flow rates, the pump is inefficient and may not provide any volume displacement of a fluid. Further, a centrifugal pump that operates on a high fluid viscosity may be impaled by the fluid wherein the pump would duplicate the operation of a mixer.

Despite the type of fluid to be transferred, a common characteristic of fluid is the ability to move fluid through use of two salient properties of fluid, namely, adhesion and viscosity. In such a manner, fluid can be propelled through a medium by reliance upon the skin resistance of a fluid.

A turbine pump developed by Tesla and patented under U.S. Pat. No. 1,061,206 sets forth the accepted embodiment and is incorporated herein by reference. The pump relies upon a plurality of flat rigid discs that are coupled to a shaft and set forth in such a manner that will allow fluid to enter along a center portion of the pump for distribution throughout the plurality of discs. Skin resistance of the fluid operates to engage the side surfaces of the discs wherein rotation thereof causes the fluid to move in correlation with the rotating discs. Unique to these pumps are the ability to transfer gas, a liquid and a solution together or in any combination for the fluids do not touch the pump because the boundary layer created between the surface parts of the disc allow the transfer of fluids that contain corrosive chemicals or even slurry type materials such as sand and dry materials.

Centrifugal force will transfer the fluid outward and when the surface tension is lost, the fluid is directed outward from the pumping chamber. Disc spacing is dependent upon fluid viscosity for optimum efficiency, however, the turbine pump can handle a wide range of viscosities by changing the rotational speed. Larger diameter discs result in a longer spiral path of fluid allowing for use with fluid of greater viscosity. Preferably, the disc spacing is such that the fluid will be accelerated to a near uniform velocity as that of the rotating disc before loss of surface tension.

Another problem with centrifugal pumps is that it is difficult to predetermine general fluid specifications and rational aspects of the pump so as to allow optimum pump efficiency.

As illustrated in FIG. 1 and 2 a prior art turbine pump 100 generally consists of a plurality of flat rigid discs 102 of suitable diameter, keyed to a shaft 104 and held in position by shoulders 106, 108 and an intermediated washer 110. The disc 102 has openings 112 adjacent to the shaft 104 leading to an outer diameter 114. The casing comprises two end casings 116 and 118 which contain the bearings for the shaft 104, stuffing boxes and outlets 120. Fluid would enter the pump into openings 112 as disc 102 rotates in a counterclockwise manner 124 wherein the fluid enters the spaces 126 between the disc 102 wherein the skin resistance of the fluid requires the fluid to become the same speed as the disc 102 until the fluid gathers sufficient momentum wherein the fluid loses surface tension with the disc 102 and is directed through outlet 120.

A problem with the prior art turbine pumps having spaced apart discs is in specification of the fluid and determination of the rotational aspects so as to match the fluid to the pump for optimum efficiency. Without such matching, the pump becomes inefficient if used with low viscosity fluids or rotated at low speeds. Therefore, what is needed in the art is a turbine pump having a means for accommodating the speed and/or viscosity of fluid so as to provide positive displacement characteristics and optimum efficiency.

SUMMARY OF THE INVENTION

The instant invention is an improvement upon the turbine style pump. Blade inserts are positioned along side surfaces of each disc in such a manner so as to force fluid from the rotating disc to the outlet of the pump during low centrifugal force situations. The blade inserts are self adjusting and accommodate to the speed of the rotating disc allowing the blade inserts to reside near the center of the disc should the viscosity of fluid or rotation of the pump be low. Increase of pump speed or submission of fluid having a higher viscosity will cause the blade inserts to travel outward allowing the fluid to reside in contact with the discs an appropriate amount of time so as to cause the fluid to match the speed of the rotating disc. The blade inserts are triangular shaped and placed along a pivotal point biased toward the inner diameter of the pump by use of a spring.

Thus, the blade inserts operate to displace the fluid for use at low rotations per minute (rpm). The blade inserts pivot outward upon sufficient hydraulic pressure causing depression of the biasing spring allowing maximum flow at high rotations per minute. This allows for the positive displacement of fluid in situations where inadequate rotations per minute would otherwise provide insufficient centrifugal action to expel fluid.

Therefore, a primary objective of the instant invention is to provide a means for improving low rotation per minute pumping volume of turbine pumps by use of pivotal disc fillers positioned between rotating discs causing a positive displacement action where insufficient centrifugal action exists to expel fluid.

Another objective of the instant invention is to provide an automatic adjustment mechanism to accommodate various rotational speeds of a pump and accommodate differences in fluid characteristics.

Still another objective of the instant invention is to provide a fully automatic fluid disbursing insert that operates to provide a positive displacement characteristic for centrifugal pumps when operating at low rotations per minute or viscosities otherwise not compatible with a surface tension type pump.

Other objects and advantages of this invention will become apparent from the following description taken in conjunction with the accompanying drawings wherein set forth, by way of illustration and example, certain embodiments of this invention. The drawings constitute a part of this specification and include exemplary embodiments of the instant invention illustrating various objects and features thereof.

DETAILED DESCRIPTION OF THE PREFERRED EMBODIMENT

As required, detailed embodiments of the present invention are disclosed herein, however, it is to be understood that the disclosed embodiments are merely exemplary of the invention which may be in various forms. Therefore, specific functional and structural details disclosed herein are not to be interpreted as limiting, but merely as a basis for the claims and as a representative basis for teaching one skilled in the art to various employ the present invention and virtually any appropriately detailed structure.

Figure 3:
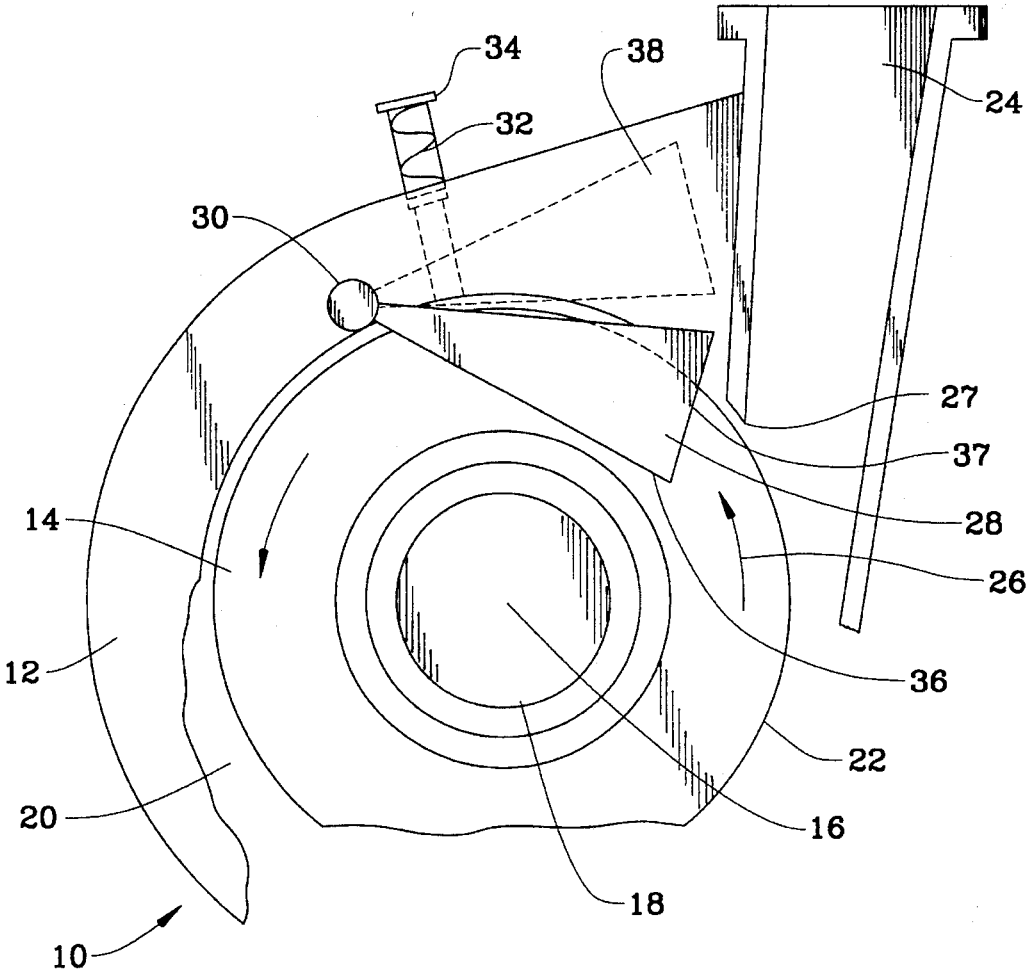
FIG. 3 is a cross-sectional end view of the instant invention as incorporated into a multi-disc pump.

Now referring to FIG. 3 shown is a cross-sectional side view of a conventional turbine style pump 10 having a housing 12 with a plurality of discs 14 rotatable around a shaft 16 that is coupled to a drive means such as an electric motor. The housing 12 has an inlet not shown but juxtapositioned to the shaft 16 wherein fluid is allowed to enter into a centrally disposed aperture 18 which allows fluid communication from an inlet opening into the inner diameter of the discs 14. The casing 12 includes a free air space 20 around the outer diameter 22 of the discs 14 which directs fluid towards outlet 24 available for coupling to a pipe for receipt of the repressurized fluid. As noted by the directional arrows 26 the plurality of discs 14 are shown rotating in a counterclockwise position wherein fluid that enters into the center opening aperture 18 is forced within the cavities formed by placement of the plurality of discs 14 a fixed distance apart so as to allow fluid having a surface tension carry along the side surfaces of the discs 14 allowing the fluid to rotate around the shaft 16 wherein the speed of the fluid will approximate the speed of the rotating discs 14 wherein centrifugal force will allow the fluid to be released from the surface tension into the free air space 20 with the fluid skimmed by wall 27 to direct the fluid to the outlet 24.

As shown by way of illustration, the pump is improved upon by use of a plurality of blade inserts 28 that are positioned along the side surface of said discs 14 and are rotatable from a normally inserted position by pivot point 30. In operation the blade inserts 28 are in a normally inserted position when no fluid is present. Spring 32 is placed within a sealed housing 34 so as to bias a lower surface 36 of the blade inserts 28 toward the center 16 of the discs 14. Fluid placed into the pump housing 12 when the discs 14 are rotated in direction 26 during low flow conditions allows the fluid to impact frontal surface 37 of the blade insert 28 forcing fluid toward the outlet 24. As the rotational aspects of the pump 10 increase, the centrifugal force of the fluid forces the lower surface 36 of the blade inserts 28 outwardly so that the blade inserts eventually will end in a storage position as shown by the hidden lines of blade insert 38. As the fluid viscosity or rotation increases, the blade inserts 28 will slowly rise from the discs 14 in correlation to the fluid as provided by biasing spring means 32. Thus, the pump becomes adjustable in low rpm situations as well as accommodating various types of fluid viscosities.

Figure 1:
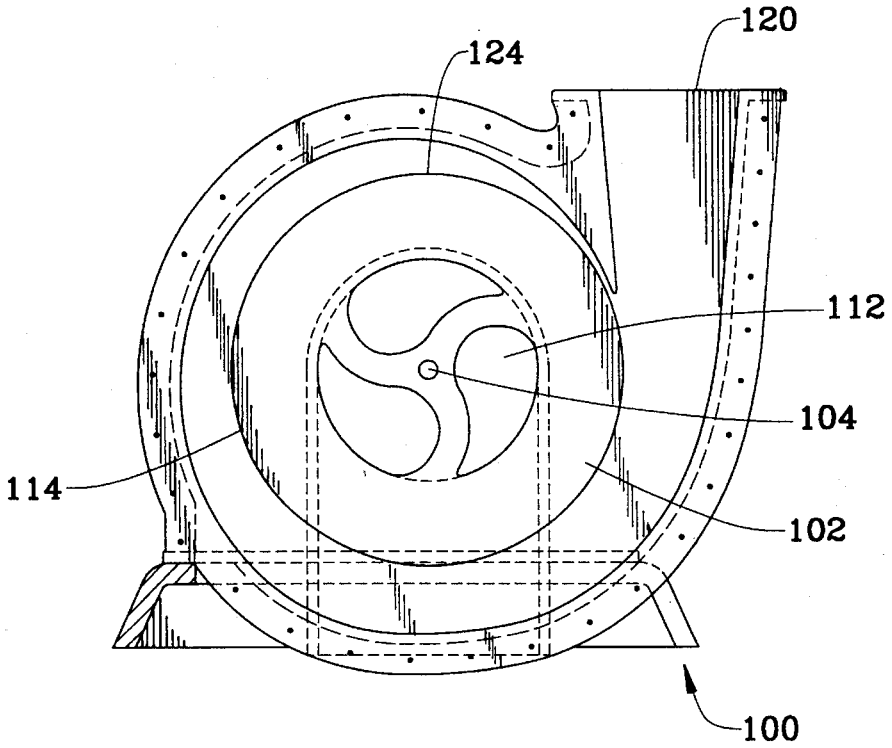
FIG. 1 (PRIOR ART)
FIG. 1 is a cross-sectional side view of the prior art pump disclosed by Tesla.
Figure 2:
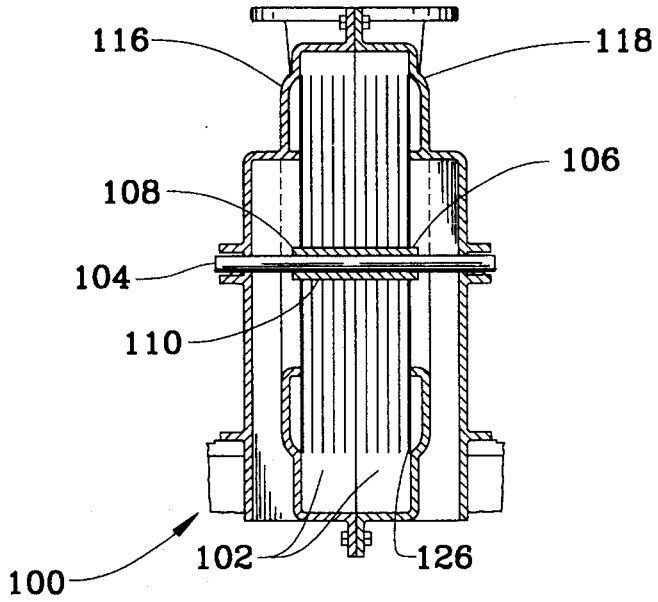
FIG. 2 (PRIOR ART)
FIG. 2 is a cross-sectional side view of FIG. 1.
Figure 4:
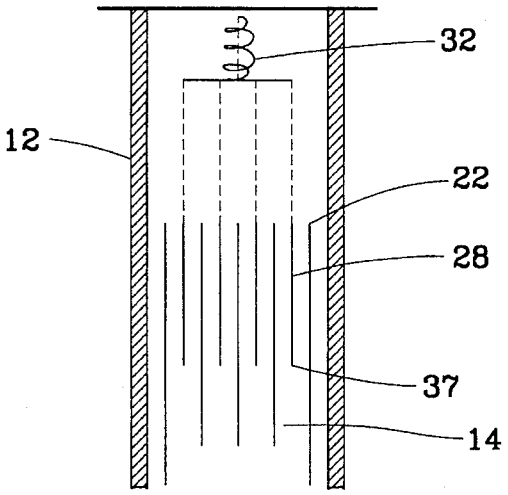
FIG. 4 is a cross-sectional top view of FIG. 3.

Now referring to FIG. 4 shown is a cross-sectional end view of FIG. 2 illustrating the plurality of discs 14 with blade inserts 28 placed between each of the discs 14 so as to remove the surface tension from the fluid and force the fluid outward through the opening by use of frontal surface 37. The greater rotations per minute of the pump allows a hydraulic pressure of the fluid to compress the spring 32 allowing the blade inserts 28 to rise above the outer diameter 22 of the discs 14 allowing the pump to operate at optimum efficiency both at low flow conditions as well as the designed conditions.

It is to be understood that while I have illustrated and described certain forms of my invention it is not to be limited to the specific forms or arrangements of components herein described. It will be apparent to those skilled in the art that various changes may be made without departing from the scope of the invention.

What is claimed is:

1. An improved turbine style pump having a casing with a centrally disposed inlet port and peripherally disposed outlet port having a plurality of spaced apart discs with a diameter between which a fluid may flow in natural spirals by reliance upon adhesive and viscous action of said discs when rotated by a motor means wherein the improvement comprises: a plurality of triangularly shaped blade inserts juxtapositioned between said spaced apart disc surfaces, said blade inserts including a frontal surface for directing fluid to said outlet port, and a compressible spring biasing said frontal surface of said blade inserts against fluid flow.

2. The improved pump according to claim 1 wherein one end of each said blade insert is pivotable allowing said blade inserts to pivot from a position between said discs to a position external an outer diameter of said discs.

3. The improvement according to claim 1 wherein said spring is compressible in response to a centrifugal force created by fluid flow.

4. The improvement according to claim 1 wherein said spring includes a member means for raising and lowering said blade inserts in unison.

5. The improved pump according to claim 1 wherein said blade inserts include a substantially flat surface extending from a pivot point to said frontal surface providing a surface receptive to the centrifugal force of fluid directed around said disc providing lift to said blade inserts upon contact with said fluid.

6. An improved turbine style pump having a casing with a centrally disposed inlet port and peripherally disposed outlet port having a plurality of spaced apart discs with a diameter between which a fluid may flow in natural spirals by reliance upon adhesive and viscous action of said spaced apart discs when rotated by a motor means wherein the improvement comprises: a plurality of pivotally disposed triangularly shaped blade inserts juxtapositioned between said spaced apart disc surfaces, said blade inserts including a frontal surface for directing fluid to said outlet port and a substantially flat surface extending from said pivot to said frontal surface providing a surface receptive to a centrifugal force of fluid providing lift to said blade inserts; and a means for biasing said blade inserts toward the interstitial regions between said spaced apart disc surfaces.

7. The improvement according to claim 6 wherein said means for biasing is further defined as a spring allowing the raising and lowering of said blade inserts in response to a centrifugal force.

* * * * *